US011506453B2

(12) United States Patent
Davies et al.

(10) Patent No.: US 11,506,453 B2
(45) Date of Patent: Nov. 22, 2022

(54) HEAT EXCHANGER SYSTEM WITH MONO-CYCLONE INLINE SEPARATOR

(71) Applicant: CONOCOPHILLIPS COMPANY, Houston, TX (US)

(72) Inventors: Paul R. Davies, Houston, TX (US); James L. Harris, Katy, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 183 days.

(21) Appl. No.: 16/664,278

(22) Filed: Oct. 25, 2019

(65) Prior Publication Data

US 2020/0149805 A1 May 14, 2020

Related U.S. Application Data

(62) Division of application No. 14/624,709, filed on Feb. 18, 2015, now Pat. No. 10,488,104.

(60) Provisional application No. 61/949,385, filed on Mar. 7, 2014.

(51) Int. Cl.

| | |
|---|---|
| ***F25B 43/00*** | (2006.01) |
| ***F25J 1/00*** | (2006.01) |
| ***F25J 1/02*** | (2006.01) |
| ***F25J 5/00*** | (2006.01) |
| ***F28D 21/00*** | (2006.01) |
| ***F28D 9/00*** | (2006.01) |

(52) U.S. Cl.

CPC ..... *F25J 1/0022* (2013.01); *F25B 43/00* (2013.01); *F25J 1/0052* (2013.01); *F25J 1/0262* (2013.01); *F25J 1/0272* (2013.01); *F25J 1/0278* (2013.01); *F25J 5/005* (2013.01); *F28D 9/0006* (2013.01); *F28D 21/0017* (2013.01); *F25B 2339/0241* (2013.01); *F25J 2205/10* (2013.01); *F25J 2250/02* (2013.01); *F25J 2250/20* (2013.01); *F25J 2290/72* (2013.01); *F28F 2265/18* (2013.01)

(58) Field of Classification Search

CPC ..... F28D 21/0017; F28D 2021/0066; F28D 2021/0033; F28D 2021/007; F28D 15/0266; F25J 3/06; F25J 1/0262; F25J 1/0272; F25J 1/0022; F25J 1/0052; F25J 1/0278; F25J 5/005; F25J 2250/02; F25J 2250/20; F25B 2339/0241

See application file for complete search history.

(56) References Cited

U.S. PATENT DOCUMENTS

| | | | | |
|---|---|---|---|---|
| 4,486,210 A * | 12/1984 | Gauthier | F25J 1/0262 | 62/619 |
| 2006/0137854 A1* | 6/2006 | Haglid | F24F 12/006 | 165/54 |
| 2011/0036122 A1* | 2/2011 | Betting | F25J 3/0233 | 62/636 |

* cited by examiner

*Primary Examiner* — Frantz F Jules
*Assistant Examiner* — Webeshet Mengesha
(74) *Attorney, Agent, or Firm* — Polsinelli PC

(57) ABSTRACT

A heat exchanger system includes a core-in-shell heat exchanger and a liquid/gas separator. The liquid/gas separator is configured to receive a liquid/gas mixture and to separate the gas from the liquid. The liquid/gas separator is connected to the core-in-shell heat exchanger via a first line for transmitting gas from the liquid/gas separator to a first region in the core-in-shell heat exchanger and connected to the core-in-shell heat exchanger via a second line for transmitting liquid from the liquid/gas separator to a second region of the core-in-shell heat exchanger.

20 Claims, 4 Drawing Sheets

HEAT EXCHANGER SYSTEM WITH MONO-CYCLONE INLINE SEPARATOR

CROSS-REFERENCE TO RELATED APPLICATIONS

This application is a divisional application which claims the benefit of and priority to U.S. application Ser. No. 14/624,709 filed Feb. 18, 2015, which is a non-provisional application that claims the benefit of and priority to U.S. Provisional Application Ser. No. 61/949,385 filed Mar. 7, 2014, entitled "HEAT EXCHANGER SYSTEM WITH MONO-CYCLONE INLINE SEPARATOR," which are hereby incorporated by reference in their entirety.

FIELD OF THE INVENTION

This invention relates to heat exchangers, and in particular, to core-in-shell heat exchanger connected in-line with a mono-cyclone liquid-gas separator.

BACKGROUND OF THE INVENTION

Natural gas in its native form must be concentrated before it can be transported economically. Liquefaction of the natural gas may be performed on land or off-shore in floating liquefaction plants. Floating liquefaction plants provide an alternative to subsea pipeline for stranded offshore reserves. The floating liquefaction plants include heat exchangers to cool the natural gas in the liquefaction process. One type of heat exchanger is the core-in-kettle, or core-in-shell, heat exchanger. The core-in-shell heat exchanger includes an outer shell partially filled with a refrigerant. At least one core is located in the outer shell and the natural gas is passed through the core. The refrigerant is also passed through the core to cool the natural gas while being maintained separate from the natural gas.

A core-in-shell heat exchanger is normally fed with a two-phase refrigerant mixture of liquid and gas. A distributor is provided in the outer shell to distribute the two-phase refrigerant. However, the flow of the two-phase refrigerant within the outer shell can result in mal-distribution of the two-phase refrigerant, and movement of the heat exchanger results in sloshing of liquid in the heat exchanger. Sloshing inside the outer shell has an adverse effect on the thermal function of the heat exchanger core.

In particular, conventional core-in-shell heat exchangers have a channel into which the two-phase refrigerant flows. The channel has slots or openings to distribute the two-phase refrigerant evenly or where desired in the core-in-shell heat exchanger. This configuration has functioned adequately in an on-shore environment, which is a stable environment. However, the configuration leads to a mal-distribution of the liquid in an offshore environment, where rocking or swaying of the core-in-shell heat exchanger leads to sloshing of the refrigerant. In particular, the sloshing of the refrigerant in the channel leads to the refrigerant entering the body of the heat exchanger in pulses and unevenly.

SUMMARY OF THE INVENTION

In one embodiment of the present invention, a heat exchanger system includes a core-in-shell heat exchanger and a liquid/gas separator. The liquid/gas separator is configured to receive a liquid/gas mixture and to separate the gas from the liquid. The liquid/gas separator is connected to the core-in-shell heat exchanger via a first line for transmitting gas from the liquid/gas separator to a first region in the core-in-shell heat exchanger and connected to the core-in-shell heat exchanger via a second line for transmitting liquid from the liquid/gas separator to a second region of the core-in-shell heat exchanger.

In another embodiment, a method of performing a heat exchange includes providing a gas/liquid mixture to a gas/liquid separator, separating gas from liquid with the gas/liquid separator, and providing the gas to a first region of a core-in-shell heat exchanger. The method includes providing the liquid to a second region of the core-in-shell heat exchanger and running the liquid in the second region through a core of the core-in-shell heat exchanger to exchange heat with a fluid running through the core.

BRIEF DESCRIPTION OF THE DRAWINGS

The invention, together with further advantages thereof, may best be understood by reference to the following description taken in conjunction with the accompanying figures by way of example and not by way of limitation, in which.

DETAILED DESCRIPTION OF THE INVENTION

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variation can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the appended claims and their equivalents.

Figure 1:
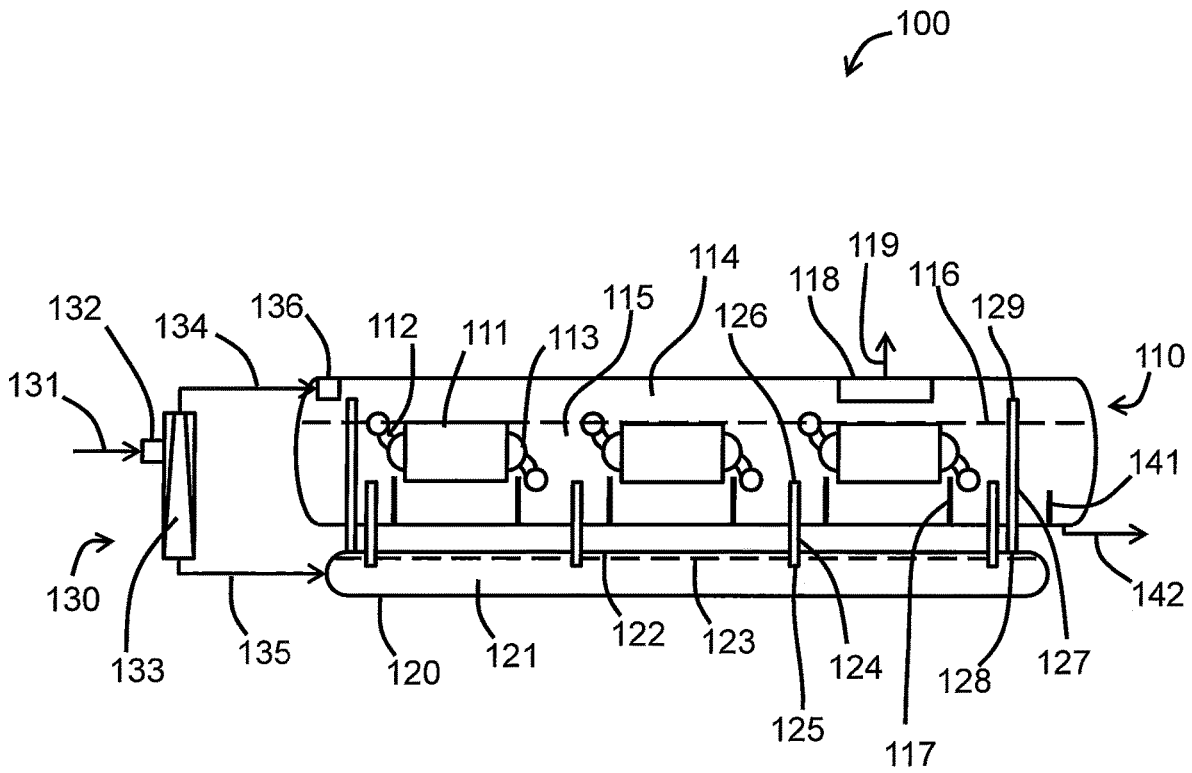
FIG. 1 illustrates a heat exchanger system according to one embodiment of the present invention.

FIG. 1 illustrates a heat exchanger system 100 according to an embodiment of the invention. The system 100 includes a core-in-shell, or core-in-kettle, heat exchanger 110, a liquid sump 120, and a liquid/gas separator 130. In the present specification, the liquid/gas separator 130 is also referred to as "separator 130" for brevity. In embodiments of the invention, a liquid/gas mixture 131 is provided to an inlet 132 of the separator 130. In one embodiment, the liquid/gas mixture 131, which may also be referred to as a two-phase mixture, is a refrigerant. The separator 130 includes a cavity 133 having a shape to cause the liquid and gas in the liquid/gas mixture 131 to separate. In one embodiment, the separator 130 is a cyclonic separator that has a cavity 133 shape that causes the liquid/gas mixture 131 to rotate within the cavity 133. In one embodiment, the cavity 133 has a conical, substantially conical, or frustoconical shape. In such an embodiment, the rotation of the liquid/gas mixture 131 within the cavity 133 causes the heavier fluid, i.e. the liquid, to move toward the walls of the cavity 133 and the gas to move toward the center of the cavity 133. In one embodiment, the liquid, having been separated from the gas, falls toward a bottom of the separator 130 due to gravity.

FIG. 1 illustrates a separator 130 having a vertical alignment, defined by a length of the separator 130 or a center axis extending through the cavity 133. In such an embodiment, gravity is used to allow a liquid to fall to be separated from a gas after being subjected to cyclonic spin. However, embodiments are not limited to a vertically-aligned separator 130. In alternative embodiments, the separator 130 may be aligned substantially-vertically, horizontally, substantially-horizontally, or in any other alignment relative to gravity.

The gas having been separated from the liquid in the separator 130 is transmitted to the core-in-shell heat exchanger 110 via a first line 134, which may also be referred to as a channel, pipe, tube, or any other means of transmitting the gas to the core-in-shell heat exchanger 110. In the present specification, the core-in-shell heat exchanger 110 may be referred to as a heat exchanger 110 for brevity. In one embodiment, an outlet of the first line 134 in the heat exchanger 110 includes a momentum-breaking device 136 to reduce the momentum of the incoming gas and evenly distribute the gas and liquid mixture. The momentum-breaking device 136 may comprise vanes, baffles, or any other structures to reduce the momentum of the incoming gas. The liquid having been separated from the gas is transmitted to the liquid sump 120 via a second line 135.

The heat exchanger 110 includes one or more cores 111 that are at least partially submerged in the liquid. In FIG. 1, reference numeral 114 represents a first region that corresponds to a region of the heat exchanger 110 containing gas separated from the liquid, reference numeral 115 represents a second region that corresponds to a region of the heat exchanger 110 containing liquid separated from the gas, and reference numeral 116 represents a liquid level during normal operation of the heat exchanger 110. While reference numeral 116 represents a liquid level of the heat exchanger 110, it is understood that during operation the actual liquid level may vary, due to sloshing, resulting in unequal liquid levels, or due to other events that cause the liquid level to be more or less than the line 116. In addition, embodiments of the invention encompass heat exchangers operating at any liquid level or any range of liquid levels.

Each core 111 includes an inlet pipe 112 and an outlet pipe 113 to pass a fluid through the core 111. During operation, the liquid from the second region 115 is also passed through the core 111 to transmit heat with the fluid passing through core 111 via the inlet pipe 112 and the outlet pipe 113. For example, in one embodiment, the liquid from the second region 115 is sucked into the core 111 from the bottom of the core 111 and is output from the top of the core 111. In one embodiment, the driving force for the liquid flow is a thermo-siphon effect due to liquid refrigerant from the second region 115 coming into contact with a hotter fluid in the core 111 and boiling inside the core 111. In one embodiment, the core 111 is a brazed core, such as a brazed metal core. One example of a brazed metal core according to an embodiment of the invention is a brazed aluminum core.

In one embodiment, the heat exchanger 110 includes sloshing baffles 117 to reduce sloshing of the liquid in the heat exchanger 110. In one embodiment, a sloshing baffle 117 is located at each end of a core 111. In one embodiment, the sloshing baffles 117 are panels mounted to a bottom and side of the internal surface of the outer shell of the heat exchanger 110 that extend a predetermined height less than the liquid level 116.

The heat exchanger 110 includes a liquid drain 142 to drain liquid from the second region 115 and a vapor vent 119 from the first region 114. In one embodiment, the heat exchanger 110 includes a weir 141 that ensures that after shutdown, liquid remains in the heat exchanger and does not drain via the liquid drain 142. In one embodiment, the heat exchanger 110 includes a de-misting device 118 at an inlet to the vapor vent 119 to ensure that vapor leaving the heat exchanger 110 has minimal liquid content.

The liquid provided to the liquid sump 120, which is also referred to as "sump 120" for brevity, is transmitted to the second region 115 of the heat exchanger 110 via risers 124. The risers 124 include inlets 125 located below a liquid level 123 in the sump 120 and an outlet 126 located below the liquid level 116 in the heat exchanger 110. In embodiments of the invention, the first region 121 of the sump 120 corresponds to a region filled with liquid, and the second region 122 corresponds to a region filled with gas or vapor. In one embodiment, the liquid is drawn from the sump into the heat exchanger 110 as a result of evaporative thermosiphon action generated by the cores 111. The cores 111 heat the liquid passing through the cores 111, drawing additional liquid from the sump 120 into the heat exchanger 110 due to hydrostatic forces. In one embodiment, the risers 124 have a size based on a required flow of the liquid through the risers 124 and an available hydrostatic pressure driving force, caused by the thermosiphon action of the cores 111. In one embodiment, the outlets 126 of the risers 124 are substantially level, or at a same height, as a bottom of the cores 111 to prevent liquid from draining out of the heat exchanger 110 during a shutdown. In one embodiment, the inlets 125 of the risers 124 are located below the liquid level 123 in the sump 120 to prevent vapor or gas from the sump 120 to flow into the second region 115 of the heat exchanger 110.

While the second region 122 is illustrated at a certain height for purposes of description, it is understood that in embodiments of the present invention, the first region 121 is very close to filling the entire sump 120. In other words, in embodiments of the invention, the gas/liquid separator 130 effectively separates gas from liquid, but some gas still exists in the "liquid." Accordingly, some gas or vapor may accumulate in a top of the sump 120. To prevent accumulation of gas or vapor in the sump 120, vapor vents 127 connect the second region 122 of the sump with the first region 114 of the heat exchanger 110. In one embodiment, an inlet 128 of the vapor vent 127 is located in a top inside surface of the sump 120, and an outlet 129 of the vapor vent 127 is located in the first region 114 of the heat exchanger 110 above the liquid line 116.

In one embodiment, one or more vapor vents 127 are located at ends of the sump 120. Accordingly, in the event that the heat exchanger system 100 is tilted, such as by the rocking of a vehicle or floating platform, the gas or vapor in the sump 120 would have a tendency to collect at the ends of the sump 120 and could thus be transmitted to the first region 114 of the heat exchanger 110. In one embodiment, the sump 120 is attached to the heat exchanger 110, such as by welded braces or connectors, or the sump 120 may be fixed with respect to the heat exchanger 110. In one embodiment, the sump 120 is located beneath the heat exchanger 110.

In embodiments of the invention, the vapor or gas from the separator 130 is combined with vapor or gas generated by the flow of liquid through the cores 111. The vapor or gas is combined in the first region 114 of the heat exchanger 110, which is designed at a predetermined size according to the design specifications of the cores 111 to provide an adequate vapor degassing space above the cores 111.

In embodiments of the invention, the separator 130 is designed to maintain a predetermined equilibrium of liquid and gas in the separator 130. Accordingly, the design specifications of the heat exchanger 110 and sump 120 must be taken into account while designing the separator 130. In particular, the separator 130 must be designed and configured such that there is a hydrostatic balance between the liquid and the vapor in the separator 130, taking into account the pressure of the liquid and vapor in the heat exchanger 110. The hydrostatic balance must be such that only liquid flows through the second line 135 and only gas or vapor flows through the first line 134.

While FIG. 1 illustrates one configuration of heat exchanger system 100 according to one embodiment of the invention, the invention is not limited to the specific embodiment illustrated or described, but rather encompasses any system for separating liquid from gas prior to transmitting the separated liquid and gas to respective sections of a heat exchanger.

Figure 2A:
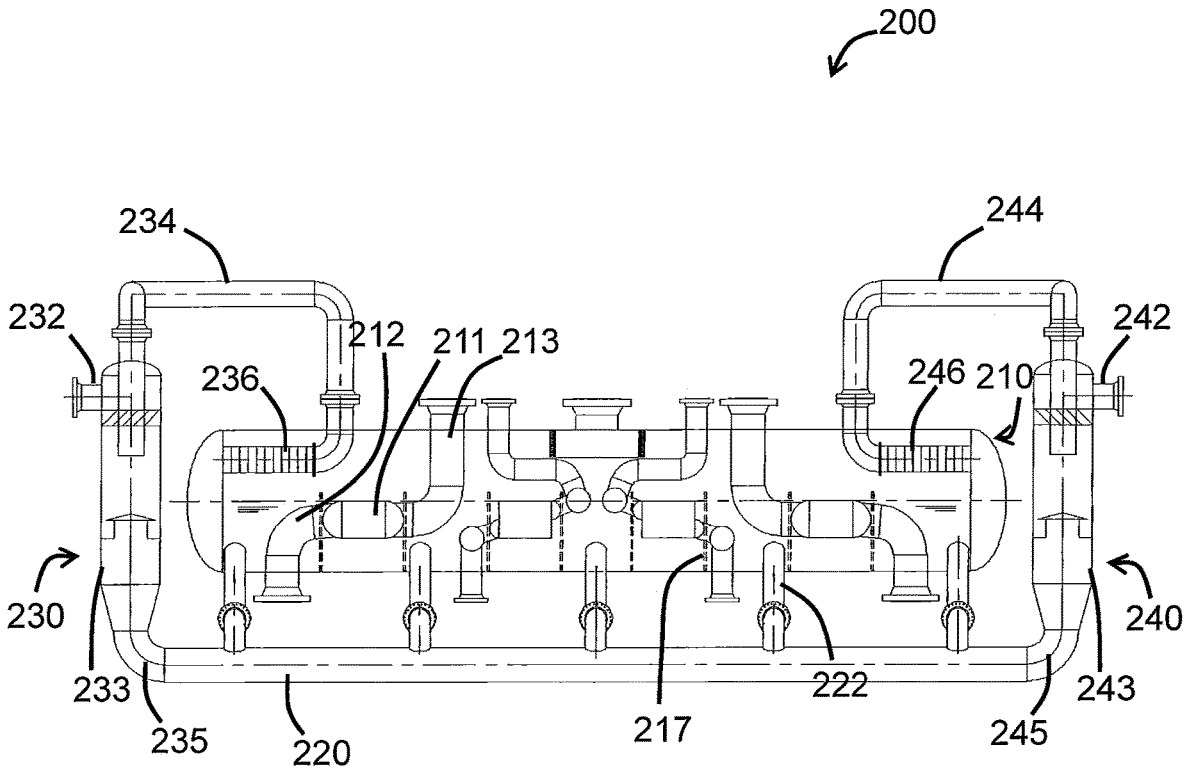
FIG. 2A illustrates a heat exchanger system according to another embodiment of the invention.
Figure 2B:
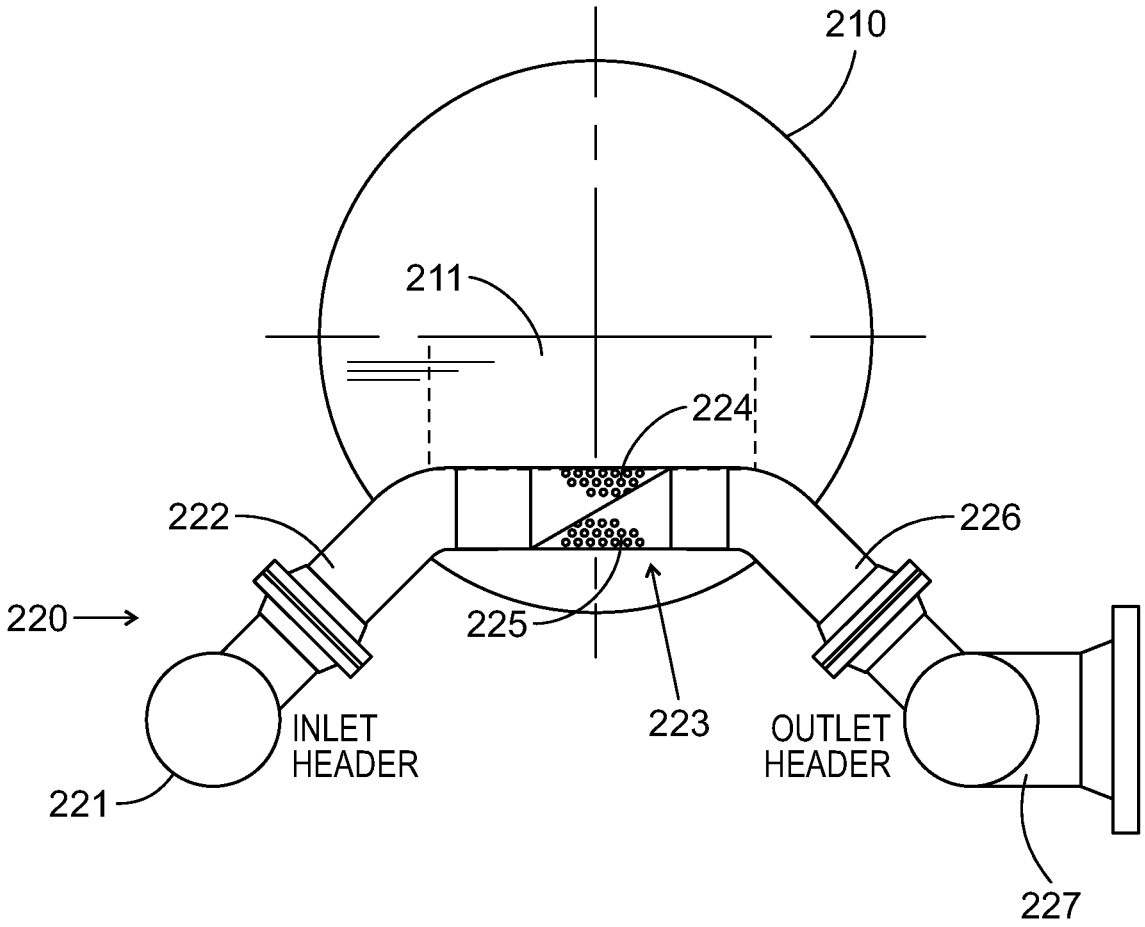
FIG. 2B illustrates a side end view of the heat exchanger system according to an embodiment of the invention.

FIGS. 2A and 2B illustrate a heat exchanger system 200 according to another embodiment of the invention. Similar to the system 100 of FIG. 1, the heat exchanger system 200 includes a core-in-shell, or core-in-kettle, heat exchanger 210, a liquid sump assembly 220, and a liquid/gas separator 230. The separator 230 includes an inlet 232 that receives a liquid/gas mixture, a cavity 233 having a shape to cause the liquid and gas in the liquid/gas mixture to separate. In one embodiment, the separator 230 is a cyclonic separator that has a cavity 233 shape that causes the liquid/gas mixture to rotate within the cavity 233. In one embodiment, the cavity 233 has a conical, substantially conical, or frustoconical shape. In such an embodiment, the rotation of the liquid/gas mixture within the cavity 233 causes the heavier fluid, i.e. the liquid, to move toward the walls of the cavity 233 and the gas to move toward the center of the cavity 233. In one embodiment, the liquid, having been separated from the gas, falls toward a bottom of the separator 230 due to gravity.

The system 200 includes a first line 234 to transmit the gas separated from the liquid/gas mixture from the separator 230 to the heat exchanger 210 via a momentum-breaking device 236. The system 200 includes a second line 235 to transmit the liquid separated from the liquid/gas mixture in the separator 230 to the sump 220.

The heat exchanger 210 includes one or more cores 211 that are at least partially submerged in the liquid. Each core 211 includes an inlet pipe 212 and an outlet pipe 213 to pass a fluid through the core 211 which exchanges heat with the liquid in the heat exchanger 210 that has been previously separated in the separator 230.

In one embodiment, the heat exchanger 210 includes sloshing baffles 217 to reduce sloshing of the liquid in the heat exchanger 210. The liquid provided to the sump 220 is transmitted to the heat exchanger 210 via risers 222. The structure of the risers 222 and the sump 220 is further illustrated in FIG. 2B.

In the embodiment illustrated in FIG. 2B, the sump 220 includes an inlet header 221 that receives the liquid from the second line 235 illustrated in FIG. 2A. The liquid is transmitted via the riser 222 to the liquid transfer portion 223. The liquid transfer portion 223 includes openings 224, such as perforations, slits, or any other openings, to permit the flow of liquid from the liquid transfer portion 223 into the core 211. In one embodiment, the openings 224 are below the liquid level in the heat exchanger 210. In one embodiment, the liquid is drawn into the core 211 from the openings 224 by evaporative thermosiphon action. In one embodiment, liquid from the riser 222 is output into the heat exchanger 210 via the openings 224 at the top of the liquid transfer portion 223, and liquid from the heat exchanger 210 is input to the sump 220 via openings 225 at the bottom of the liquid transfer portion 223, providing a flow of liquid, such as refrigerant, into and out from the heat exchanger 210. The liquid from the liquid transfer portion 223 travels through the outlet conduit 226 to an outlet header 227, where it may be stored, recycled, or used in any other manner.

Referring again to FIG. 2A, in one embodiment, the system 200 further includes a second separator 240 including an inlet 242, cavity 243, a third line 244 for transmitting gas from the second separator 240 to the heat exchanger 210, and a fourth line 245 for transmitting liquid from the second separator 240 to the sump 220. The system 200 may also include a momentum-breaking device 246 to reduce the momentum of gas from the third line 244 into the heat exchanger 210. In one embodiment, the separator 230 is at one end of the heat exchanger 210 and the second separator 240 is at the opposite end of the heat exchanger 210. In one embodiment, the configuration of the separator 230 and second separator 240 are symmetrical about the heat exchanger 210. In some embodiments, a distance of the piping from the separator 230 and the second separator 240 to the heat exchanger 210 is substantially identical. In other words, in some embodiments, the first line 234 has a same length as the third line 244, and the second line 235 has the same length as the fourth line 245.

Figure 3:
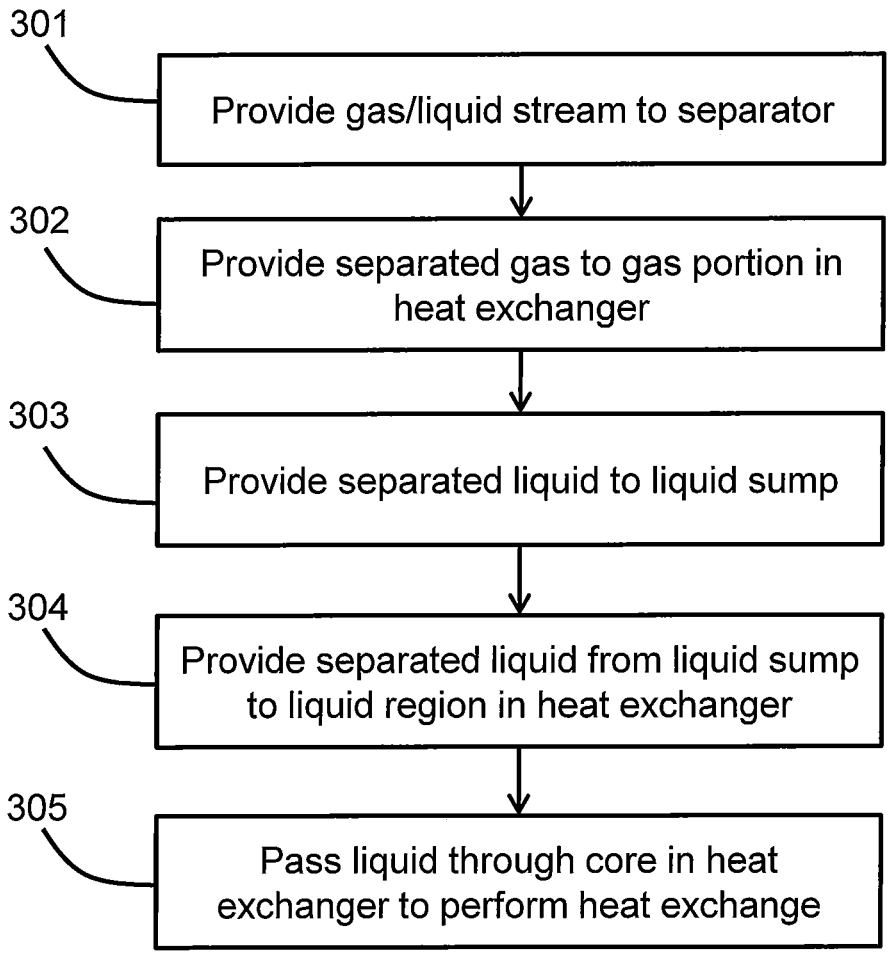
FIG. 3 illustrates a method according to an embodiment of the invention

FIG. 3 is a block diagram illustrating a method for performing a heat exchange according to an embodiment of the invention. In block 301, a gas/liquid stream is provided to a separator. In one embodiment, the separator is a cyclonic gas/liquid separator, as described above. In such an embodiment, separating the gas from the liquid includes rotating the gas/liquid mixture in the gas/liquid separator. The heavier liquid migrates to the walls of the separator, and the lighter gas and vapor migrates to a region that is inward from the liquid. In one embodiment, the gas/liquid stream is a stream of refrigerant.

In block 302, the separated gas is provided to a gas region of a core-in-shell heat exchanger. The gas region may be a region that is filled with gas or vapor during normal operation of the heat exchanger. The volume and boundary of the gas region may be predetermined according to the required or specified level of liquid in the heat exchanger during normal operation of the heat exchanger.

In block 303, the separated liquid is provided to a liquid sump. The liquid sump is in fluid communication with the heat exchanger, and in block 304, the liquid is provided from the sump to a liquid region of the heat exchanger. In one embodiment, the liquid sump is fixed relative to the heat exchanger. In one embodiment, the liquid sump is located beneath the heat exchanger, and the liquid from the sump is sucked into the liquid region of the heat exchanger via a thermosiphon effect of liquid being drawn into, and evaporated by, cores in the heat exchanger. In one embodiment, the liquid from the liquid sump is transmitted to the heat exchanger by transmitting the liquid through a riser having an inlet below a liquid level in the sump and an outlet below a liquid level in the heat exchanger.

In block 305, the liquid in the heat exchanger is passed through a core in the heat exchanger to exchange heat with another fluid passing through the heat exchanger. In one embodiment, the other fluid is a hot fluid, and the liquid in the heat exchanger is at least partially evaporated by the core. In such an embodiment, liquid is drawn into the core according to the thermosiphon principle, and the gas or vapor resulting from the evaporation during the heat exchange is combined with the separated gas from the gas separation in block 301.

In embodiments of the invention residual gas or vapor in the separated liquid that is provided to the sump in block 303 may be transmitted to the gas region of the heat exchanger via a gas or vapor vent. In addition, gas and vapor in the heat exchanger may be evacuated via a gas or vapor vent in the top of the heat exchanger. In addition, in embodiments of the invention, liquid may be output from the heat exchanger via a liquid drain in the bottom of the heat exchanger.

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

What is claimed is:

1. A heat exchanger system comprising:

a core-in-shell heat exchanger;

a liquid/gas separator connected to the core-in-shell heat exchanger via a first line and a second line, the liquid/gas separator operable to receive a liquid/gas mixture and separate a gas from a liquid, the first line operable to transmit the gas from the liquid/gas separator to a first region in the core-in-shell heat exchanger, the second line operable to transmit the liquid from the liquid/gas separator to a second region of the core-in-shell heat exchanger; and a liquid sump connected to the liquid/gas separator via the second line, the liquid sump connected to the core-in-shell heat exchanger via a riser such that the liquid sump is located below the core-in-shell heat exchanger, the riser extending from a top of the liquid sump into a bottom of the core-in-shell heat exchanger, the riser operable to transmit the liquid from the liquid sump to the second region of the core-in-shell heat exchanger.

2. The heat exchanger system of claim 1, wherein, the first region defines a gas region in which gas is located during operation of the heat exchanger system, and the second region defines a liquid region in which liquid is located during operation of the heat exchanger system.

3. The heat exchanger system of claim 1, wherein the liquid-gas separator is a cyclonic liquid/gas separator.

4. The heat exchanger system of claim 1, wherein the liquid sump includes:

an inlet header for receiving liquid from the liquid/gas separator;

a liquid transfer portion connected to the inlet header and configured to transmit the liquid from a liquid header into the core-in-shell heat exchanger; and an outlet header connected to the liquid transfer portion configured to receive the liquid from the heat exchanger.

5. The heat exchanger system of claim 4, wherein the liquid transfer portion includes perforations to permit liquid flow between the core-in-shell heat exchanger and the liquid sump.

6. The heat exchanger system of claim 1, wherein the riser has an inlet located below a liquid level in the liquid sump and an outlet located inside the second region of the core-in-shell heat exchanger.

7. The heat exchanger system of claim 1, further comprising:

a vapor vent line connecting the liquid sump to the core-in-shell heat exchanger, the vapor vent line having an inlet at a top of the liquid sump and an outlet in the first region of the core-in-shell heat exchanger.

8. The heat exchanger system of claim 7, wherein the vapor vent line includes a first vapor vent line at one end of the liquid sump and a second vapor vent line at an opposite end of the liquid sump.

9. The heat exchanger system of claim 1, further comprising:

a device at an outlet of the first line in the core-in-shell heat exchanger, the device operable to reduce a momentum of the gas from the first line.

10. The heat exchanger system of claim 1, wherein the liquid/gas separator comprises:

a first liquid/gas separator at a first end of the core-in-shell heat exchanger; and a second liquid/gas separator at on opposite end of the core-in-shell heat exchanger, wherein each of the first and second liquid/gas separators is configured to receive a liquid/gas mixture and to separate the gas from the liquid, the first liquid/gas separator is connected to the core-in-shell heat exchanger via the first line for transmitting gas from the first liquid/gas separator to the first region in the core-in-shell heat exchanger and connected to the core-in-shell heat exchanger via the second line for transmitting liquid from the first liquid/gas separator to the second region of the core-in-shell heat exchanger, and the second liquid/gas separator is connected to the core-in-shell heat exchanger via a third line for transmitting gas from the second liquid/gas separator to the first region in the core-in-shell heat exchanger and connected to the core-in-shell heat exchanger via a fourth line for transmitting liquid from the second liquid/gas separator to the second region of the core-in-shell heat exchanger.

11. The heat exchanger system of claim 1, wherein, the liquid/gas separator includes a configuration based on a pressure in the core-in-shell heat exchanger, and the configuration of the liquid/gas separator is operable to prevent a flow of liquid through the first line and a flow of gas through the second line using a hydrostatic pressure of the liquid and gas in the liquid/gas separator.

12. A heat exchanger system comprising:

a core-in-shell heat exchanger;

a liquid/gas separator connected to the core-in-shell heat exchanger via a first line and a second line, the liquid/gas separator operable to receive a liquid/gas mixture and separate a gas from a liquid, the first line operable to transmit the gas from the liquid/gas separator to a first region in the core-in-shell heat exchanger, the second line operable to transmit the liquid from the liquid/gas separator to a second region of the core-in-shell heat exchanger; and a liquid sump connected to the liquid/gas separator via the second line, the liquid sump connected to the core-in-shell heat exchanger via a riser, the riser having an inlet located below a liquid level in the liquid sump and an outlet located inside the second region of the core-in-shell heat exchanger, the riser operable to transmit the liquid from the liquid sump to the second region of the core-in-shell heat exchanger.

13. The heat exchanger system of claim 12 comprising:

a vapor vent line connecting the liquid sump to the core-in-shell heat exchanger.

14. The heat exchanger system of claim 13, wherein the liquid sump is located below the core-in-shell heat exchanger such that the riser extends from a top of the liquid sump into a bottom of the core-in-shell heat exchanger.

15. The heat exchanger system of claim 13, wherein the vapor vent line includes an inlet at a top of the liquid sump and an outlet in the first region of the core-in-shell heat exchanger.

16. The heat exchanger system of claim 12, wherein, the liquid/gas separator includes a configuration based on a pressure in the core-in-shell heat exchanger, and the configuration of the liquid/gas separator is operable to prevent a flow of liquid through the first line and a flow of gas through the second line using a hydrostatic pressure of the liquid and gas in the liquid/gas separator.

17. A heat exchanger system comprising:

a core-in-shell heat exchanger;

a liquid/gas separator connected to the core-in-shell heat exchanger via a first line and a second line, the liquid/gas separator operable to receive a liquid/gas mixture and separate a gas from a liquid, the first line operable to transmit the gas from the liquid/gas separator to a first region in the core-in-shell heat exchanger, the second line operable to transmit the liquid from the liquid/gas separator to a second region of the core-in-shell heat exchanger;

a liquid sump connected to the liquid/gas separator via the second line, the liquid sump connected to the core-in-shell heat exchanger and operable to transmit the liquid to the second region of the core-in-shell heat exchanger; and a vapor vent line connecting the liquid sump to the core-in-shell heat exchanger, the vapor vent line having an inlet at a top of the liquid sump and an outlet in the first region of the core-in-shell heat exchanger.

18. The heat exchanger system of claim 17, wherein the liquid/gas separator includes a configuration based on a pressure in the core-in-shell heat exchanger.

19. The heat exchanger system of claim 18, wherein the configuration of the liquid/gas separator is operable to prevent a flow of liquid through the first line and a flow of gas through the second line using a hydrostatic pressure of the liquid and gas in the liquid/gas separator.

20. The heat exchanger system of claim 17, wherein, the first region defines a gas region in which gas is located during operation of the heat exchanger system, and the second region defines a liquid region in which liquid is located during operation of the heat exchanger system, and the liquid-gas separator is a cyclonic liquid/gas separator.

* * * * *